US009759051B2

(12) United States Patent
Twidale

(10) Patent No.: US 9,759,051 B2
(45) Date of Patent: Sep. 12, 2017

(54) PROGRESSING CAVITY PUMP SYSTEM WITH FLUID COUPLING

(71) Applicant: Cameron International Corporation, Houston, TX (US)

(72) Inventor: Derek L. Twidale, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 254 days.

(21) Appl. No.: 14/581,621

(22) Filed: Dec. 23, 2014

(65) Prior Publication Data

US 2015/0184498 A1 Jul. 2, 2015

Related U.S. Application Data

(60) Provisional application No. 61/921,903, filed on Dec. 30, 2013.

(51) Int. Cl.

| | |
|---|---|
| ***E21B 43/12*** | (2006.01) |
| ***E21B 47/00*** | (2012.01) |
| ***F04C 2/107*** | (2006.01) |
| ***F04C 13/00*** | (2006.01) |
| ***F04C 14/08*** | (2006.01) |
| ***F04C 15/00*** | (2006.01) |
| *F04C 11/00* | (2006.01) |

(52) U.S. Cl.

CPC ..... *E21B 43/128* (2013.01); *E21B 47/0007* (2013.01); *F04C 2/1073* (2013.01); *F04C 13/008* (2013.01); *F04C 14/08* (2013.01); *F04C 15/008* (2013.01); *F04C 15/0061* (2013.01); *F04C 11/008* (2013.01)

(58) Field of Classification Search

None

See application file for complete search history.

(56) References Cited

U.S. PATENT DOCUMENTS 2,311,963 A * 2/1943 Pyle ..... E21B 43/38 166/105.5
2,850,918 A * 9/1958 Pollard ..... F16H 47/08 475/41
2,952,494 A * 9/1960 Tiraspolsky ..... E21B 4/02 384/124

(Continued)

OTHER PUBLICATIONS

Peikert, "Variable Speed Fluid Couplings Driving Centrifugal Compressors and Other Centrifugal Machinery", Proceedings of the Thirteenth Turbomachinery Symposium, Nov. 1984, pp. 59-65, Texas A&M Universtiy Press, College Station, Texas.

*Primary Examiner* — Shane Bomar

(74) *Attorney, Agent, or Firm* — Eubanks PLLC

(57) ABSTRACT

A progressing cavity pump operated by a motor is provided. In one embodiment, a system includes a motor, a progressing cavity pump having a rotor and a stator, and a fluid coupling that connects the motor to the progressing cavity pump. The fluid coupling includes an input turbine and an output turbine disposed within a housing. The motor is connected to the input turbine of the fluid coupling and the rotor of the progressing cavity pump is connected to the output turbine of the fluid coupling to enable the progressing cavity pump to be operated by the motor via the fluid coupling to pump fluid through the progressing cavity pump. Additional systems, devices, and methods are also disclosed.

11 Claims, 4 Drawing Sheets

(56) References Cited

U.S. PATENT DOCUMENTS

| | | | | |
|---|---|---|---|---|
| RE37,995 | E * | 2/2003 | Barrus | E21B 43/128 166/107 |
| 7,836,973 | B2 * | 11/2010 | Belcher | E21B 17/042 175/25 |
| 9,322,218 | B2 * | 4/2016 | Russell | E21B 4/02 |
| 2003/0098181 | A1 | 5/2003 | Aronstam et al. | |
| 2006/0202651 | A1 * | 9/2006 | Washeleski | E05F 15/697 318/280 |
| 2007/0046115 | A1 * | 3/2007 | Tetzlaff | E21B 43/128 310/71 |
| 2008/0128128 | A1 | 6/2008 | Vail et al. | |
| 2009/0025942 | A1 * | 1/2009 | Hall | E21B 7/068 166/381 |
| 2010/0087290 | A1 * | 4/2010 | Schoenek | B60K 6/383 477/5 |
| 2012/0292112 | A1 | 11/2012 | Lakic | |
| 2013/0277116 | A1 | 10/2013 | Knull et al. | |

* cited by examiner

PROGRESSING CAVITY PUMP SYSTEM WITH FLUID COUPLING

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource. Further, such systems generally include a wellhead assembly mounted on a well through which the resource is accessed or extracted. These wellhead assemblies can include a wide variety of components, such as various casings, valves, pumps, fluid conduits, and the like, that control drilling or extraction operations.

In some instances, resources accessed via wells are able to flow to the surface by themselves. This is typically the case with gas wells, as the accessed gas has a lower density than air. This can also be the case for oil wells if the pressure of the oil is sufficiently high to overcome gravity. But often the oil does not have sufficient pressure to flow to the surface and it must be lifted to the surface through one of various methods known as artificial lift. Artificial lift can also be used to raise other resources through wells to the surface, or for removing water or other liquids from gas wells. Some forms of artificial lift use a pump that is placed downhole in the well, such as a progressing cavity pump having a stator that cooperates with a helical rotor to draw fluid up the well.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to progressing cavity pumping systems. More specifically, in certain embodiments a pumping system includes a progressing cavity pump coupled to a motor with a fluid coupling. The motor and a rotor of the progressing cavity pump can be connected to turbines in the fluid coupling such that rotation of one of the turbines by the motor induces rotation of the other turbine and the rotor. In various embodiments, the pumping rate of the progressing cavity pump can be varied by controlling the operating speed of the motor or by controlling slip within the fluid coupling.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom,"

"above," "below," other directional terms, and variations of these terms is made for convenience, but does not require any particular orientation of the components.

Figure 1:
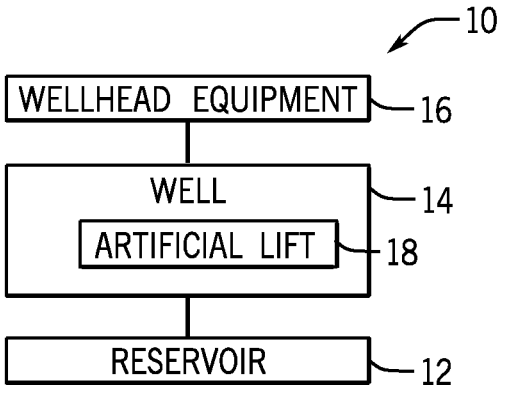
FIG. 1 is a block diagram of components of a production system having an artificial lift apparatus to draw fluid from a well to the surface in accordance with one embodiment of the present disclosure.

Turning now to the present figures, a system 10 is illustrated in FIG. 1 in accordance with one embodiment. Notably, the system 10 is a production system that facilitates extraction of a resource, such as oil, from a reservoir 12 through a well 14. Wellhead equipment 16 is installed on the well (e.g., attached to the top of casing and tubing strings in the well). In one embodiment, the wellhead equipment 16 includes a casing head and a tubing head. But the components of the wellhead equipment 16 can differ between applications, and such equipment could include various casing heads, tubing heads, stuffing boxes, pumping tees, and pressure gauges, to name only a few possibilities.

Figure 2:
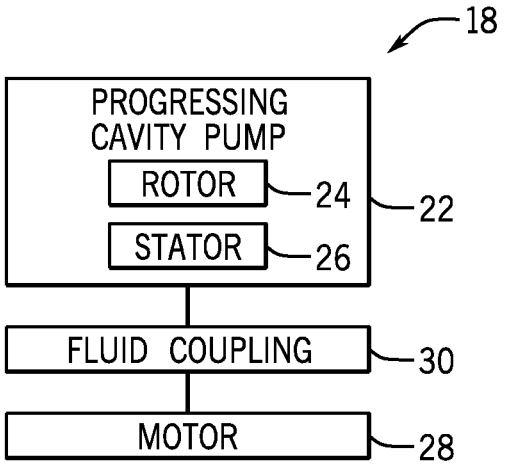
FIG. 2 is a block diagram of various components of the artificial lift apparatus of FIG. 1, including a progressing cavity pump connected to a motor via a fluid coupling, in accordance with one embodiment.

The system 10 also includes an artificial lift apparatus 18. In one embodiment generally depicted in FIG. 2, the artificial lift apparatus 18 includes a progressing cavity pump 22 that operates as a downhole pump in the well 14. The progressing cavity pump 22 includes a rotor 24 and a stator 26. When provided as a downhole pump, the rotor 24 rotates with respect to the stator 26 to pump fluid through the pump 22 and up through the well 14 to the surface.

The depicted artificial lift apparatus 18 also includes a motor 28 that is coupled to the progressing cavity pump 22 by a fluid coupling 30. Any suitable motor 28 could be used, such as an alternating current motor or permanent magnet motor. The fluid coupling 30 is a hydrodynamic device that functions to convert the output speed of the motor 28 to a lower speed suitable for operating the progressing cavity pump 22. In at least some embodiments, the fluid coupling 30 is a variable-speed fluid coupling. As described in greater detail below, the motor 28 drives rotation of a first turbine in the fluid coupling 30 to induce rotation of a second turbine connected to the rotor 24. This allows the progressing cavity pump 22 to be operated by the motor 28 for pumping wellbore fluid (e.g., oil and water from the reservoir 12) through the pump 22 and out of the well 14.

Figure 3:
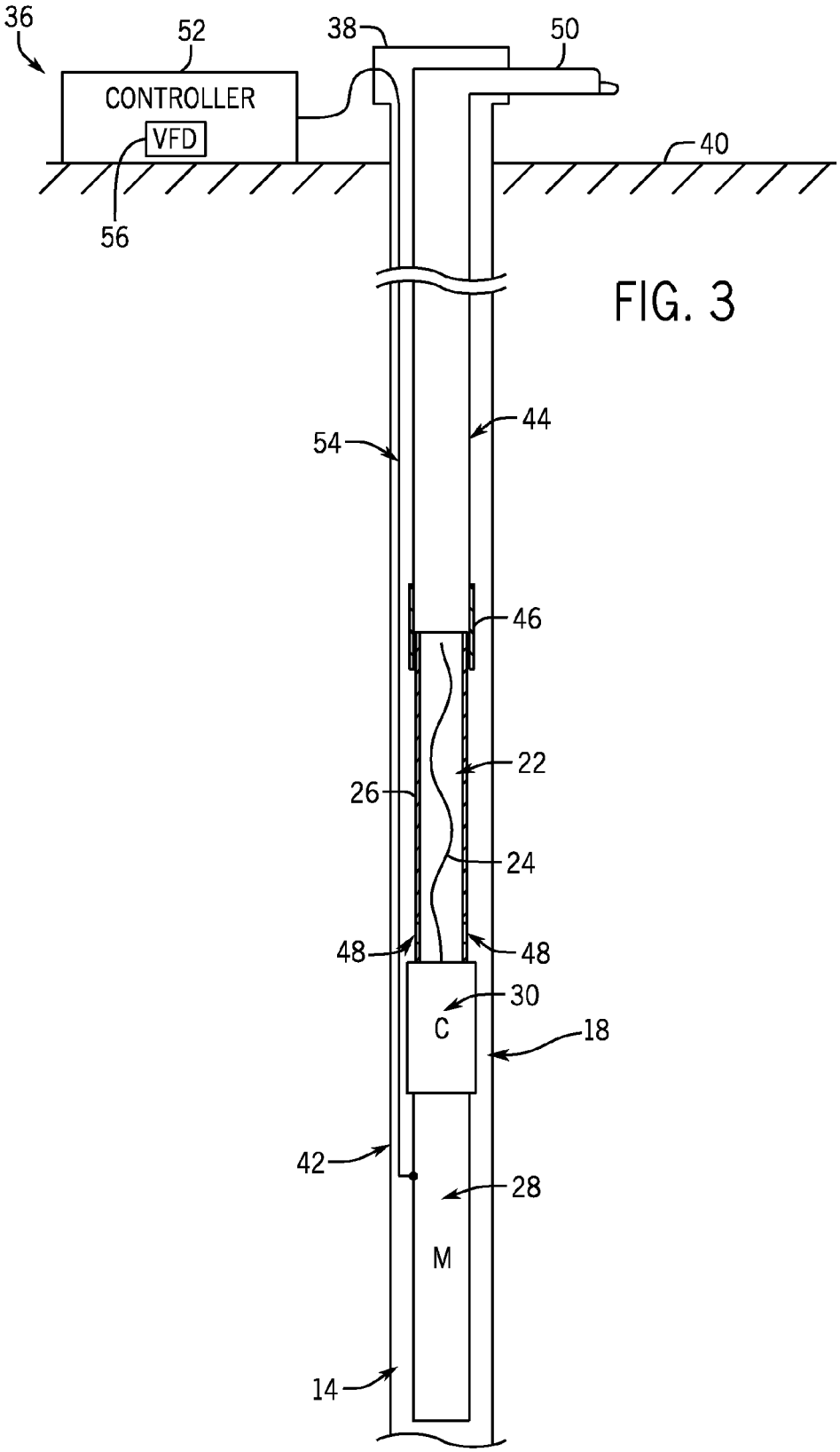
FIG. 3 generally depicts the artificial lift apparatus of FIG. 2 installed downhole within a well to enable pumping of wellbore fluid to the surface in accordance with one embodiment.

By way of example, an oilfield system 36 having a progressing cavity pump 22 driven by a motor 28 via a fluid coupling 30 is generally illustrated in FIG. 3. The system 36 includes a wellhead 38 provided at a surface 40 and connected to casing 42 provided within the well 14. The progressing cavity pump 22 is generally depicted as having its rotor 24 within the stator 26 and coupled at one end to the fluid coupling 30. The motor 28 is connected to the other end of the fluid coupling 30 to allow the motor 28 to cause rotation of the rotor 24 within the stator 26. While the apparatus 18 is illustrated as being within a vertical portion of the well 14 in FIG. 3, it is noted that the apparatus 18 could be used in other positions, such as within a horizontal portion of a well.

The progressing cavity pump 22 is also attached to production tubing 44 in the well 14. As here depicted, a collar 46 can be used to connect the production tubing 44 and a discharge end of the progressing cavity pump 22. But these two components can be connected to one another in any suitable manner. Operation of the motor 28 induces rotation of the rotor 24 of the pump 22, causing fluid in the well 14 to be drawn into the pump 22 through inlets 48 and pumped through the stator 26 and the production tubing 44 to the surface 40. The fluid pumped to the surface 40 can be routed to various collection systems through an outlet line 50.

In at least some embodiments the motor 28 is an electric motor, such as an alternating current motor. Further, the motor 28 can be an electric submersible pump motor. The system 36 includes a controller 52 outside the well 14 that is connected to the motor 28 via a power cable 54. The controller 52 is depicted as having a variable-frequency drive 56 for controlling the operating speed of the motor 28, which facilitates control of the pumping rate of the pump 22. But in other embodiments the controller 52 could control operation of the motor 28 without having a variable-frequency drive 56. As discussed in additional detail below, the fluid coupling 30 translates the operating speed of the motor 28 to a lower operating speed for the pump 22. In at least some embodiments, such as that depicted in FIG. 3, this allows the motor 28 to drive the pump 22 without a gearbox for reducing rotational output from the motor 28 (e.g., 3,600 rpm) to a speed appropriate for operating the pump 22.

Figure 4:
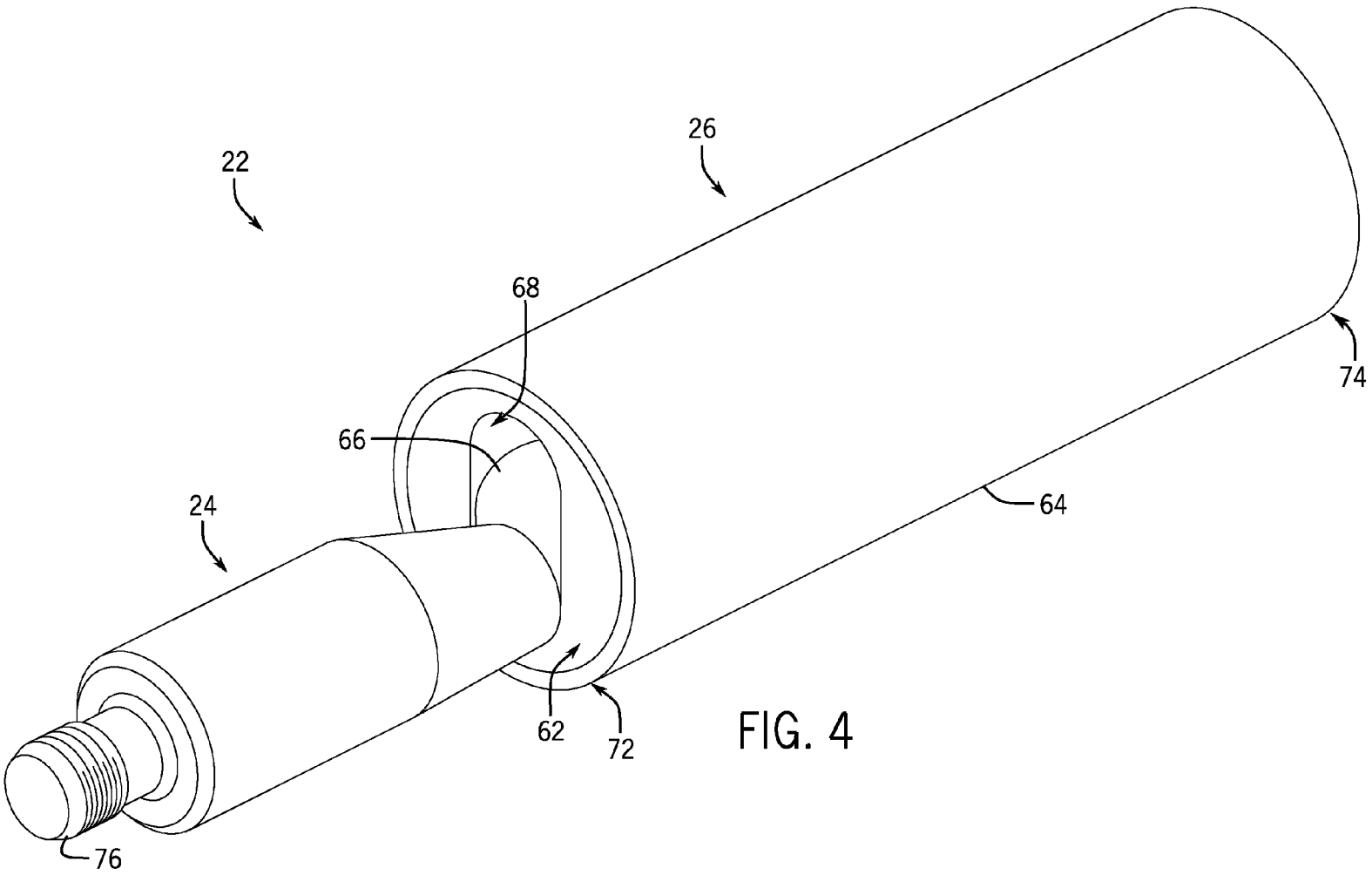
FIG. 4 is a perspective view of a progressing cavity pump that may be operated by a motor and a fluid coupling in accordance with one embodiment.

One embodiment of a progressing cavity pump 22 is illustrated in FIG. 4. The stator 26 of the pump 22 includes a stator core 62 installed within a housing 64. By way of example, the stator core 62 can be an elastomer core having a winding conduit 68 for receiving the rotor 24 or can be formed from a series of metal plates that are rotationally staggered to form the winding conduit 68. In at least one embodiment, the pump 22 is a single-lobe pump in which the conduit 68 generally winds through the stator core 62 in the form of a double helix and the rotor 24 includes a helical profile 66 (which may also be considered to include a spiraled tooth for engaging the stator 26) positioned within the conduit 68 of the stator core 62. But the pump 22 could be provided as a multiple-lobe pump in other embodiments. It will also be appreciated that the stator core 62 can be installed in the bore of the housing 64 and retained in any suitable fashion. For example, the stator core 62 could be bonded to the housing 64, retained by an interference fit, or retained by end caps coupled to the housing 64.

The rotor 24 seals against the inner surface of the stator 26 to retain fluid within individual cavities in the conduit 68 between the rotor 24 and the stator core 62. When the rotor 24 is turned, these individual cavities progress in winding fashion about the rotor 24 and through the stator 26 from an intake end (e.g., end 72) to a discharge end (e.g., end 74) such that fluid is drawn through the stator 26 at a rate that varies based on the rotational speed of the rotor 24 about its axis. The rotor 24 can be connected (e.g., via a threaded connection end 76) to an output shaft from the fluid coupling 30, allowing the output shaft to drive rotation of the rotor 24.

Figure 5:
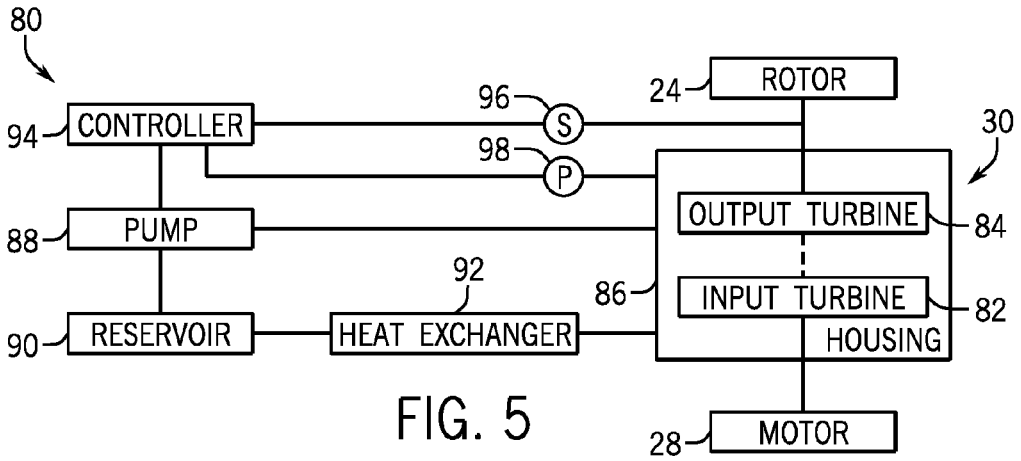
FIG. 5 is a block diagram of a system having a fluid coupling between a motor and a progressing cavity pump rotor, as well as other components for controlling the operating speed of the pump rotor, in accordance with one embodiment.

Although the pumping rate of the pump 22 can be varied by adjusting the operating speed of the motor 28, the pumping rate can also be varied through control of the fluid coupling 30. For instance, as depicted in FIG. 5, a system 80 includes the rotor 24 coupled to the motor 28 by the fluid coupling 30, and additional components for regulating speed of the rotor 24 via the fluid coupling 30. The fluid coupling 30 includes an input turbine 82 and an output turbine 84 within a housing 86 containing fluid (e.g., hydraulic fluid). As will be appreciated, the input turbine 82 and the output turbine 84 can have various blades to interact with the fluid within the housing 86. The input turbine 82 is connected to the motor 28 (e.g., to an output shaft of the motor). The mechanical output of the motor 28 causes the input turbine 82 to rotate within the housing 86. This rotation of the input turbine 82 moves the fluid within the housing 86 toward the output turbine 84 (as generally represented by the dashed line connecting these two components in FIG. 5), causing the output turbine 84 to rotate in the same direction as the input turbine 82. The output turbine 84 is connected to the rotor 24 of the pump 22 (e.g., via a shaft coupled to threaded connection end 76), allowing the rotation of the output turbine 84 to drive rotation of the rotor 24.

The pumping rate of the progressing cavity pump 22 depends on the rotational speed of the rotor 24. In some embodiments, the operating speed of the motor 28 can be varied (e.g., with the variable-frequency drive 56) to change the rotational speed of the input turbine 82. This causes a related change in the rotational speed of the output turbine 84 and the rotor 24. But in other embodiments, the pumping rate of the pump 22 can be controlled through manipulation of the fluid coupling 30, rather than by the motor 28.

In operation, the rotational speeds of the input turbine 82 and the output turbine 84 generally differ. The difference between these two speeds is called slip and can be expressed as a percentage of the speed of the input turbine 82. In some embodiments, the pumping rate of the pump 22 can be varied by controlling the amount of slip within the fluid coupling 30.

The system 80, for example, is configured to vary the amount of fluid within the fluid coupling 30 to control slip. Particularly, the system 80 includes a pump 88 for controlling the amount of hydraulic fluid in the housing 86. Hydraulic fluid can be added to the housing 86 from a reservoir 90. The system 80 also includes a heat exchanger 92 for cooling the hydraulic fluid. The heat exchanger 92 may be provided in fluid communication between the reservoir 90 and the housing 86, as shown in FIG. 5, or could be located elsewhere in the system 80. Egress of hydraulic fluid from the housing 86 to the heat exchanger 92 can be controlled in any suitable manner, such as with a check valve that opens when pressure within the housing 86 exceeds a threshold or with an actively controlled valve.

A controller 94 sends operating commands (e.g., start and stop) to the pump 88 to control the amount of fluid within the housing 82. Speed sensor 96 allows the controller 94 to monitor the rotational speed of rotor 24 and to operate the pump 88 accordingly to adjust the slip of the fluid coupling 30. The controller 94 can also be used to monitor other parameters, such as pressure within the housing 86 via a pressure sensor 98. The controller 94 can be provided in any desired location, such as downhole with the fluid coupling 30.

Figure 6:
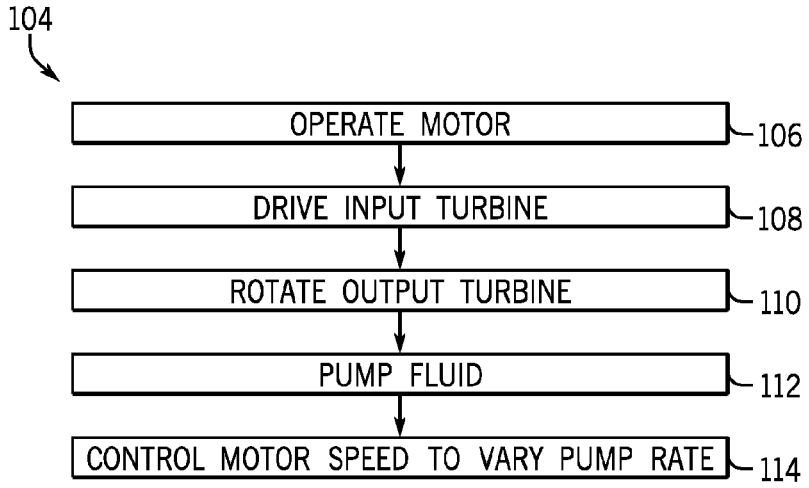
FIG. 6 is a flow chart representing a method for varying the pumping rate of a progressing cavity pump by controlling the speed of a motor connected to the pump via a fluid coupling in accordance with one embodiment.

As noted above, the pumping rate of the progressing cavity pump 22 can be controlled in different ways. For example, in one embodiment generally represented by flow chart 104 in FIG. 6, a motor can be operated to drive an input turbine of a fluid coupling, as indicated in blocks 106 and 108. The rotation of the input turbine imparts rotation to an output turbine of the fluid coupling (block 110), causing a rotor of a pump (e.g., progressing cavity pump 22) connected to the output turbine to also rotate and pump fluid (block 112) through the pump. In this manner, the torque is applied to the output turbine and the rotor of the pump from rotation of the input turbine. The motor speed can be controlled (block 114) to vary the pumping rate of the pump. For instance, the speed of the motor 28 can be increased or decreased (e.g., with the variable-frequency drive 56) to cause a corresponding change in the pumping rate of the progressing cavity pump 22.

Figure 7:
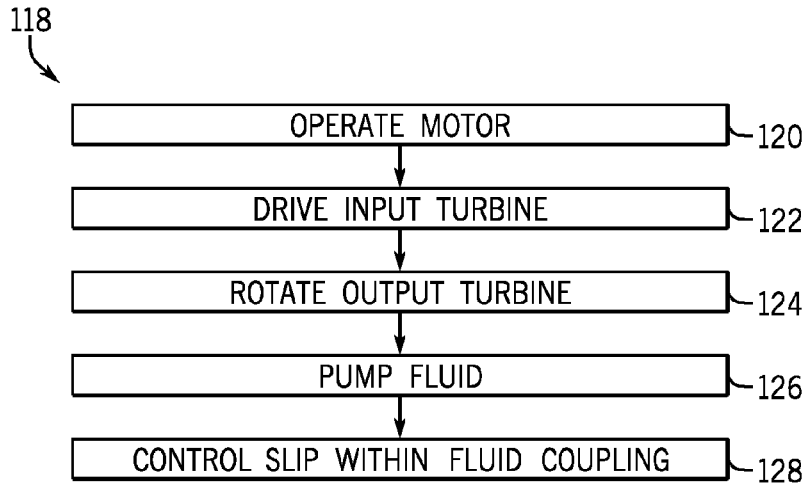
FIG. 7 is a flow chart representing a method for varying the pumping rate of a progressing cavity pump by controlling slip within a fluid coupling between a motor and the pump in accordance with one embodiment.

In another embodiment generally represented by flow chart 118 in FIG. 7, the motor can also be operated (block 120) to drive rotation of the input turbine (block 122), causing rotation of the output turbine (block 124) and pumping of fluid through the pump (block 126) as discussed above. But rather than controlling the pumping rate of pump via the operating speed of the motor, the pumping rate can instead be controlled by varying slip within the fluid coupling (block 128). More specifically, the amount of hydraulic fluid within the fluid coupling can be increased or decreased to vary the efficiency of the fluid coupling, causing the rotational speed of the output turbine 84 and the pumping rate of the pump to vary accordingly. In at least some instances, variation of the hydraulic fluid fill level within the fluid coupling to adjust the amount of slip is based on a monitored rotational speed of the output turbine while pumping wellbore fluid through the progressing cavity pump 22.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Instead, the invention is to cover all modifications, equivalents, and alternatives falling within the spirit and scope of the invention as defined by the following appended claims.

The invention claimed is:

1. A system comprising:

a motor;

a progressing cavity pump having a rotor and a stator;

a fluid coupling connecting the motor to the progressing cavity pump, the fluid coupling including an input turbine and an output turbine disposed within a housing, wherein the motor is connected to the input turbine of the fluid coupling and the rotor of the progressing cavity pump is connected to the output turbine of the fluid coupling to enable the progressing cavity pump to be operated by the motor via the fluid coupling to pump fluid through the progressing cavity pump;

a reservoir having hydraulic fluid;

an additional pump connected in fluid communication with the reservoir and with the fluid coupling to provide the hydraulic fluid from the reservoir to the fluid coupling;

a sensor to measure rotational speed of the output turbine; and a controller to command operation of the additional pump, based on the measured rotational speed, to cause a change in the rotational speed of the output turbine.

2. The system of claim 1, comprising production tubing coupled to a discharge end of the progressing cavity pump.

3. The system of claim 2, wherein the progressing cavity pump, the motor, and the fluid coupling are disposed downhole within a wellbore to facilitate pumping of the fluid through the progressing cavity pump and out of the wellbore via the production tubing.

4. The system of claim 1, wherein the motor includes an alternating current motor.

5. The system of claim 4, wherein the controller includes a variable-frequency drive electrically connected to the alternating current motor to enable the variable-frequency drive to control the operating speed of the alternating current motor.

6. The system of claim 1, wherein the controller is configured to vary pumping speed of the progressing cavity pump by controlling slip within the fluid coupling.

7. The system of claim 1, wherein the controller is configured to vary pumping speed of the progressing cavity pump by controlling the operating speed of the motor.

8. The system of claim 1, comprising a heat exchanger in fluid communication with the reservoir to enable cooling of the hydraulic fluid.

9. The system of claim 1, wherein the motor, the progressing cavity pump, and the fluid coupling are provided downhole within a wellbore and the controller is provided outside the wellbore.

10. A method comprising:

operating a motor provided downhole within a well;

using a mechanical output of the motor to drive rotation of an input turbine of a fluid coupling provided downhole within the well;

causing rotation of an output turbine of the fluid coupling from the driven rotation of the input turbine, wherein the output turbine is connected to a rotor of a progressing cavity pump;

rotating the rotor with torque applied to the output turbine from rotation of the input turbine to pump wellbore fluid through the progressing cavity pump and out of the well; and varying the pumping rate of the progressing cavity pump by controlling slip between the input turbine and the output turbine within the fluid coupling, wherein controlling slip between the input turbine and the output turbine includes:

monitoring rotational speed of the output turbine while pumping the wellbore fluid through the progressing cavity pump; and operating an additional pump based on the monitored rotational speed of the output turbine to change an amount of hydraulic fluid within the fluid coupling.

11. The method of claim 10, comprising varying the pumping rate of the progressing cavity pump by controlling the operating speed of the motor.

* * * * *